United States Patent [19]

van Esdonk et al.

[11] 4,121,131

[45] Oct. 17, 1978

[54] COLOR TELEVISION DISPLAY TUBE AND METHOD OF MANUFACTURING SAME

[75] Inventors: Johannes van Esdonk; Petrus Franciscus Antonius Haans, both of Eindhoven, Netherlands

[73] Assignee: U.S. Philips Corporation, New York, N.Y.

[21] Appl. No.: 757,347

[22] Filed: Jan. 6, 1977

[30] Foreign Application Priority Data

Jan. 16, 1976 [NL] Netherlands ..... 7600422

[51] Int. Cl.[2] ..... H01J 29/07; H01J 9/02

[52] U.S. Cl. ..... 313/402; 313/403; 29/25.17

[58] Field of Search ..... 313/402, 403, 408, 268, 313/257, 378, 296, 297

[56] References Cited

U.S. PATENT DOCUMENTS

| | | | |
|---|---|---|---|
| 1,837,566 | 12/1931 | McIlvaine | 313/257 X |
| 2,916,649 | 12/1959 | Levin | 313/250 |
| 3,016,474 | 1/1962 | Hergenrotner | 313/408 X |
| 3,060,789 | 10/1962 | Hicks | 313/475 X |
| 3,141,106 | 7/1964 | Kapany | 313/475 |
| 3,243,655 | 3/1966 | Roxburgh | 313/257 X |
| 3,435,274 | 3/1969 | Miller | 313/257 X |
| 3,586,900 | 6/1971 | Seki et al. | 313/408 X |

*Primary Examiner*—Robert Segal

*Attorney, Agent, or Firm*—Frank R. Trifari; Algy Tamoshunas

[57] ABSTRACT

In an assembly of at least two electrodes which are connected together in an insulating manner, said electrodes are kept at a given distance from each other by at least one member of an electrically insulating material situated between the electrodes which comprises a core which determines the distance between the electrodes and a jacket which directly adheres to the electrode material by heating. The material of the core has a higher melting point than the material of the jacket so that the core during effecting a connection between the jacket and the electrode material maintains its shape.

13 Claims, 7 Drawing Figures

COLOR TELEVISION DISPLAY TUBE AND METHOD OF MANUFACTURING SAME

Figure 1A:
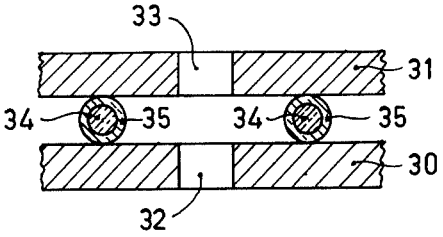

The invention relates to a colour display tube provided with colour selection means which comprise two lens electrode systems which are connected together by insulation material for postfocusing the electron beam generated in the tube.

The invention furthermore relates to a method of manufacturing such a colour display tube.

In the manufacture of electric discharge devices it frequently occurs that certain electrodes have to be assembled in an insulated manner relative to each other and at a defined distance from each other which often is very small. U.S. Pat. No. 2,916,649 discloses an electrode assembly of which adjacent electrodes are kept spaced apart by means of ceramic spacing members. The spacing members are maintained in their places by cavities or holes in the electrodes, while the assembly is kept together by a compression spring. The accuracy in the distance between the electrodes depends not only on the tolerances in the dimensions of the spacing members but also on the tolerances in the dimensions of the cavities or holes in the electrodes. The use of pressure members to keep the electrode assembly together is furthermore not always possible.

U.S. Pat. No. 3,398,309 discloses a colour display tube of the post-focusing type in which a lens of the unipotential type is formed in each of the apertures of the colour selection means. The colour selection means consist of electrodes which are separated by two insulating layers and to which suitable potentials are applied so as to exert a focussing action on the electron beams passing through the apertures.

It is the object of the invention to provide a colour display tube of the post focusing type in which the colour selection means comprise a first and a second system of lens electrodes which on the one hand are kept spaced apart at a defined distance from each other and on the other hand are mechanically connected together in an electrically insulating manner according to a simple construction.

According to the present invention, a lens electrode belonging to a first system is connected in an insulating manner to a lens electrode belonging to a second system by means of an insulating member which is present between the facing surfaces of the electrodes and which consists of a core which determines the distance between the electrodes and a jacket which is directly stuck to the electrodes, of which member the core consists of a material having a higher melting-point than the material of the jacket.

The advantage of the invention is that the spacing member between the electrodes forms one assembly with the material with which the electrodes are secured together. This simplifies the steps for the manufacture of an assembly of electrodes as meant above considerably as compared with those in which the spacing member and the adhesive material are provided separately.

The insulating member preferably consists of a glass core and a glass jacket, the glass of the core having a higher softening temperature than the glass of the jacket. Suitably the insulating member has a ceramic core and a glass jacket. The insulating member may have any desired or a shape, for example a sphere or cylinder. However, a cylindrical shape can more readily be realized than, for example, a spherical shape.

The colour selection means preferably comprise only two systems of lens electrodes in such manner that upon applying a voltage difference between the said two systems, a quadrupole lens is formed in each of the apertures of the colour selection means the electric field of which is at right angles to or substantially at right angles to the electron beams passing through the aperture. As compared with the colour selection means disclosed in U.S. Pat. No. 3,398,309, the present colour selection means have the advantage that only two instead of three electrode systems need be connected together. In addition, a quadrupole lens is comparatively stronger than a unipotential lens so that a lower potential difference is required for the former.

In one embodiment of said colour selection means a first system of lens electrodes is formed by a metal plate comprising apertures arranged in rows and the second system of lens electrodes is formed by a grid of conductive strips which are connected together electrically, which strips are positioned between the rows of apertures of the plate and are each kept at a defined distance from the plate by at least one insulating member consisting of a core which determines the distance between a relevant strip and the plate and a jacket which is directly secured to the strip and the plate, the core of said member consisting of a material having a higher melting-point than the material of the jacket.

In another embodiment of the colour selection means the two systems of lens electrodes each consist of a grid of conductive strips connected together electrically, which grids cross each other and are kept at a defined distance from each other by means of insulating members which are present between the grids and consist of a core which determines the distance between the grids and a jacket which directly adheres to the material of the grids, the core of said insulating members consisting of a material having a higher melting-point than the material of the jacket.

Figure 1B:
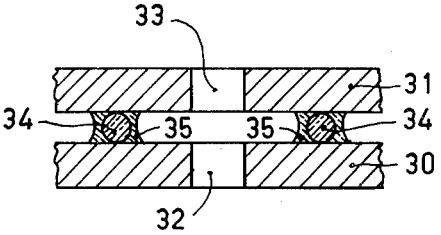
Figure 4:
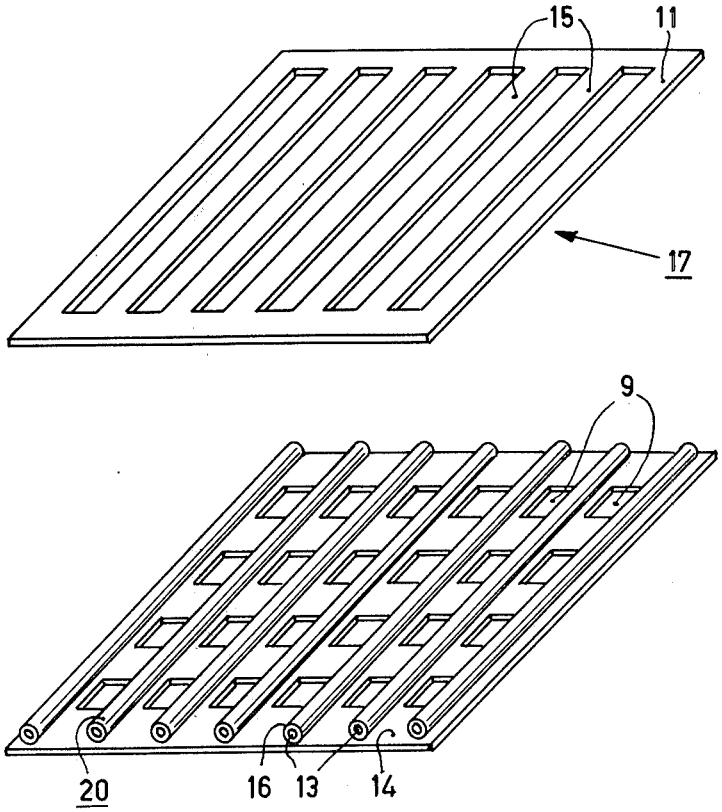
Figure 2:
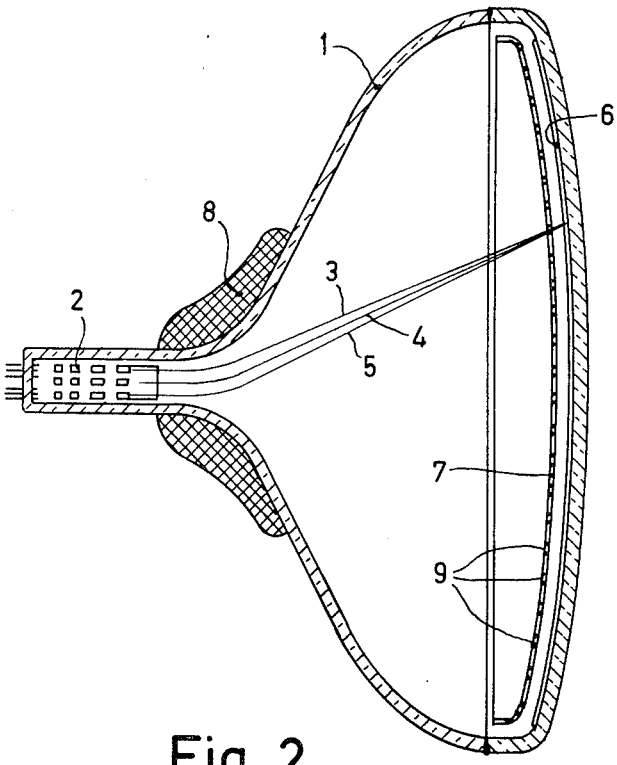
Figure 3:
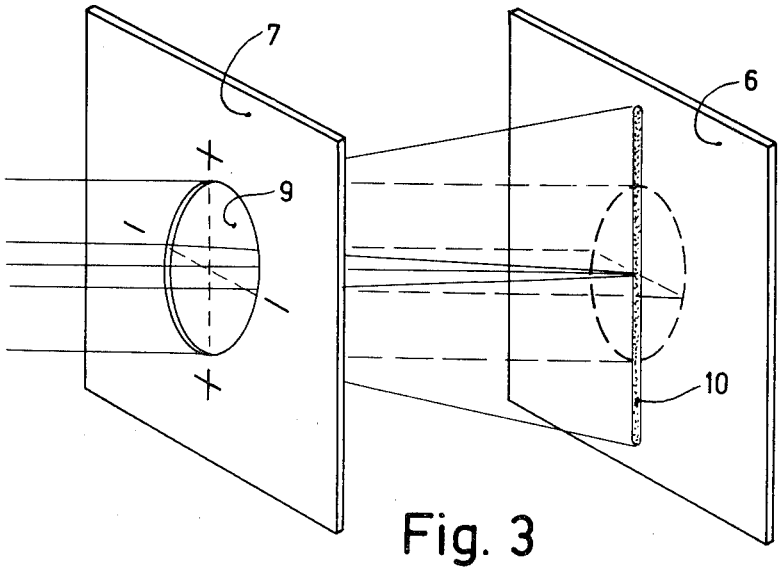
Figure 5:
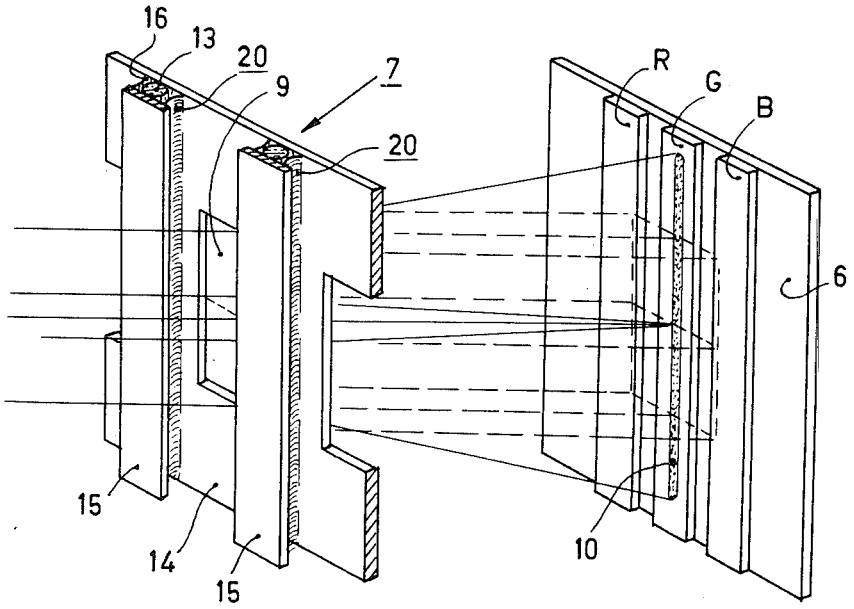
Figure 6:
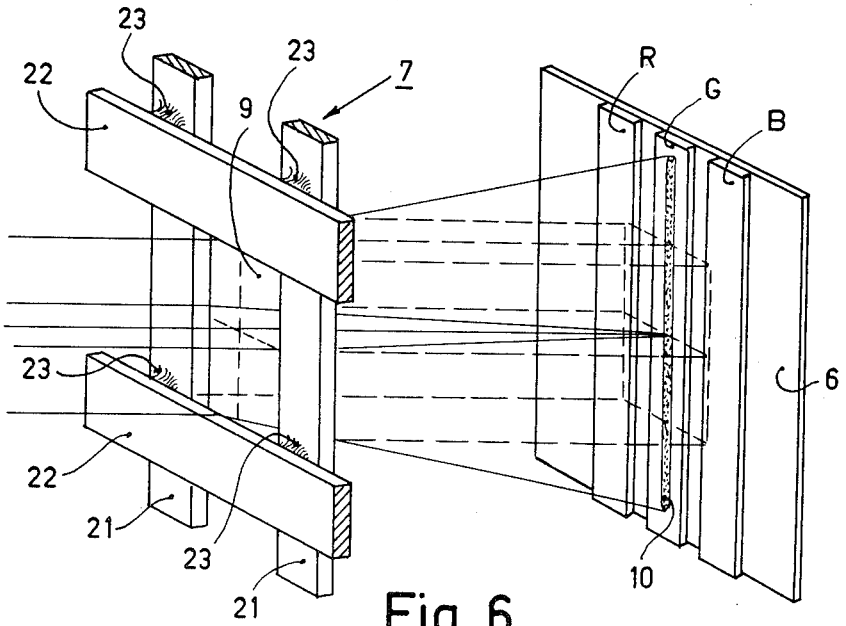

Embodiments of the invention will be described by way of example in greater detail with reference to the diagrammatic drawings, in which:

FIGS. 1*a* and 1*b* show two phases during the manufacture of an assembly of two electrodes connected together in an insulating manner and embodying the invention, FIG. 2 is a sectional view of a colour display tube provided with colour selection means comprising two systems of lens electrodes connected together and embodying the invention, FIG. 3 illustrates the principle of the postfocusing effect of a quadrupole lens, FIG. 4 shows an intermediate phase in the manufacture of an embodiment of colour selection means built up from two lens electrode systems, FIG. 5 shows a detail of the colour selection means shown in FIG. 4, and FIG. 6 shows a detail of another embodiment of the colour selection means.

The electrode assembly shown in FIGS. 1*a* and 1*b* consists of a first electrode 30 and a second electrode 31 which form part of a first and a second system of lens electrodes. The two electrodes comprise apertures 32 and 33, respectively, for passing an electron beam. The electrode 30 is kept at a defined distance from the electrode 31 by two cylindrical members each consisting of a fibre having a hard glass core 34 and a soft glass jacket 35. The core 34 has a diameter of 125 microns and consists of glass of the following composition: 69.7% by weight $SiO_2$, 17.4% by weight $Na_2O$, 0.2% by weight $K_2O$, 8.9% by weight CaO, 0.5% by weight ZnO, 0.6% by weight MnO, 2.6% by weight $Al_2O_3$ and 0.1% by weight MgO. The jacket 35 consists of glass of the composition: 56% by weight $SiO_2$, 7.7% by weight $Na_2O$, 4.5% by weight $K_2O$, 29.8% by weight PbO, 1.4% by weight $Al_2O_3$, 0.4% by weight $Sb_2O_3$ and 0.2% by weight MnO. FIG. 1*a* shows the situation in which the electrodes are not yet connected together. The assembly shown in FIG. 1*a* is heated in a furnace to a temperature at which the glass of the jacket softens but the core still maintains its shape. By means of, for example, a weight the electrode 31 is moved towards the electrode 30, the jacket 35 being deformed and the glass thereof adhering to the electrode 30 and the electrode 31. Due to the higher softening temperature of the glass of the core, the latter maintains its shape and the distance between the electrodes does not become smaller than the diameter of the core 34. After cooling, the assembly as shown in FIG. 1*b* is obtained. The thickness of the jacket 35 is not critical and is shown to be much thicker in the drawing, for reasons of clarity, than is necessary for a sufficient adhesion to the electrode surfaces. A thickness for the jacket of, for example, 25 microns is sufficient. For the manufacture of such fibers known methods may be used in which the starting material is, for example, a cylindrical member having a hard glass core and a soft glass jacket of a given diameter. This member is then heated and expanded in the longitudinal direction to form a fibers having the desired diameter. The composition of the glass of the core and the glass of the jacket is chosen in agreement with the requirements which are to be imposed thereon as regards, for example, the electrical insulation. A combination which is favourable in this respect is, for example, a core of glass having the composition: 52.8% by weight $SiO_2$, 28.8% by weight BaO, 9.6% by weight $K_2O$, 2.1% by weight $Na_2O$, 2% by weight CaO, 3% by weight $Al_2O_3$, 1% by weight $CeO_2$ and 0.7% by weight $LiO_2$, while the jacket consists of a potassium-zinc-phosphate glass or a barium-aluminum-borate glass. An embodiment of the invention will now be further explained in connection with a colour display tube provided with colour selection means which exert a postfocusing effect on the electron beams generated therein.

FIG. 2 shows a colour display tube having colour selection means composed of two electrode systems, which electrode systems are connected together in the manner described with reference to FIG. 1. The tube comprises a glass envelope 1, means 2 to generate three electron beams 3, 4 and 5, a display screen 6, colour selection means 7 and deflection coils 8. The electron beams 3, 4 and 5 are generated in one plane, the plane of the drawing of FIG. 2, and are deflected over the display screen 6 by means of the deflection coils 8. The display screen 6 consists of a large number of phosphor strips luminescing in red, green and blue and the longitudinal direction of which is at right angles to the plane of the drawing of FIG. 2. During normal operation of the tube the phosphor strips are vertical and FIG. 2 hence is a horizontal sectional view of the tube. The colour selection means 7 comprise a large number of apertures 9 in which a quadrupole lens is formed during operation of the tube. The three electron beams 3, 4 and 5 pass through the apertures 9 at a small angle with each other and hence each impinge only upon phosphor strips of one colour. The apertures 9 in the colour selection means 7 are hence very accurately positioned relative to the phosphor strips of the display screen 6.

FIG. 3 illustrates the principle of the postfocusing effect of a quadrupole lens and shows, a part of the colour selection means 7 and one of the apertures 9. The potential variation along the edge of the aperture 9, denoted by +, −, +, − is such that a quadrupole lens is formed. The electron beam which passes through the aperture 9 is focused in the horizontally drawn plane and is defocused in the vertically drawn plane so that, when the display screen is exactly in the horizontal focus, the electron spot 10 is formed. As will be described hereinafter it is preferable not to focus exactly on the display screen 6 so that a slightly wider electron spot is obtained. There is only a minor influence on the focusing when the electron beam passes through the aperture 9 at a small angle. The colour selection of the three electron beams 3, 4 and 5 hence takes place in a manner analogous to that of the known shadow mask tube. As a result of the strong postfocusing of the electron beams, however, the aperture 9 may be much larger than in the known shadow mask tube as a result of which a far greater number of electrons impinge upon the display screen 6 and a brighter picture is obtained. The defocusing in a vertical direction need not be any objection when phosphor strips are used which are parallel to the longitudinal direction of the spot 10.

A first embodiment of the colour selection means 7 will be described with reference to FIG. 4. The starting materials for the manufacture of the colour selection means are a first iron plate 11 and a second iron plate 14. The two plates 11 and 14 have a thickness of 100 microns. By means of a known photoetching method, slots are etched in the plate 11 in such manner that a grid 17 of parallel strips 15 is obtained. The strips have a width of 0.26 mm and the slots have a width of 0.54 mm. Square holes 9 of 0.54 × 0.54 mm are etched in the second iron plate 14 with a pitch of 0.8 mm so that an apertured plate is obtained. Fibers 20 consisting of a hard glass core 13 having a diameter of 100 microns and a soft glass jacket 16 are positioned on the plate 14 between the rows of apertures 9. The grid 17 with the strips 15 positioned opposite the fibers 20 is pressed against the apertured plate after which the assembly is heated in a furnace to the softening temperature of the glass of the jacket 16 but well below the softening temperature of the glass of the core. In an analogous manner to that described with reference to FIGS. 1*a* and 1*b*, the grid 17 is stuck to the apertured plate, the distance between the grid and the apertured plate being determined by the hard material of the core of the fibers and being hence in this case 100 microns. The positioning of the fibers 20 on the apertured plate can be realised in several manners. Simultaneously with the etching of the apertures 9 in the plate 14, recesses can be etched on two oppositely located edges of the plate at a distance of 0.8 mm from each other. The place of said recesses is such that the line joining two oppositely located recesses lies centrally between two successive rows of apertures. The above-mentioned fibers are then wound as a continuous wire around the apertured plate and positioned in the recesses of the two oppositely located edges. In order to avoid the fiber breaking at the edges of the apertured plate, it is advisable to lay the apertured plate on a thick base plate and to wind the fiber around the assembly of base plate and apertured plate. The grid 17 is then pressed against the fibers by means of a pressure mould and the fibers are cut at the edge of the apertured plate. A second way of positioning the fibers is to use a template in the form of a grid having slots the width of which is the same as the diameter of the fibers. Such a template is laid on the apertured plate, the slots being positioned between the rows of apertures. The fibers are then positioned in the slots, after which the template may be removed. In this case it is necessary for the fibers to adhere to the plate so that they remain in their places when the template is removed. For that purpose, a layer of adhesive may be provided on the plate which disappears, for example, at the temperatures at which a final adhesion between the jacket of the fibers and the electrode material is realized. According to this method, spherical connection members may also be used instead of fibers. In that case the template consists of a plate having apertures of the same size as the diameter of the spherical members.

After securing the electrode systems, together, the colour selection means can be given a shape adapted to the display screen, for example a cylindrical shape, by welding it on a supporting frame with a cylindrically extending edge.

FIG. 5 shows a detail of a colour selection means obtained by the method as described with reference to FIG. 4. For postfocusing the electron beams of which FIG. 5 shows only the beam directed on the green luminescing phosphor line G, the colour selection means may be operated at the following voltages. At a potential of the display screen 6 of 25 kV, a potential of the plate 14 of likewise 25 kV, and a potential of the conductive strips 15 of 23.4 kV, the focal distance of the quadrupole lenses is 18 mm with perpendicular incidence in the center of the display screen and is 12.7 mm at the edge of the display screen where the electron beams are incident at an angle of 37° to the normal of the display screen. The distance between display screen 6 and the colour selection means 7 is 15 mm in the center of the display screen and is 10 mm at the edge. The electron spots in the center of the display screen are then 0.10 mm wide and they are 0.09 mm wide in the corners. The width of the phosphor strips R, G and B is 0.13 mm. The remainder of the display screen may eventually be provided with a light-absorbing material.

Another embodiment of the colour selection means 7 is shown in FIG. 6. The two systems of lens electrodes consist of grids of parallel metal strips having a thickness of 100 microns. Two strips 21 of the grid forming the first system of lens electrodes and two strips 22 of the grid forming the second system of lens electrodes are shown. The strips 21 and 22 cross each other at right angles and are connected together only at the crossings by means of spherical insulating members. In this case a template is used consisting of a plate having apertures of the same size as the diameter of the spherical members, as is indicated with reference to FIG. 4. It is also possible to use fibers as connection members and to use a slotted template for the positioning thereof. The longitudinal direction of the fibers then is parallel to that of the strips 22, so that the fibers are in the "shadow" of the strips 22 and the electron beams do not impinge on them. The strips have a width of 0.24 mm and a mutual pitch of 0.80 mm so that the transmission of the colour selection means is approximately 50% and each of the apertures 9 forms a square of 0.56 × 0.56 mm. At a potential of the display screen 6 of 25 kV and a potential of the horizontal conductors 22 of 25.45 kV and of the vertical conductors 21 of 24.55 kV, the focal distance of the quadrupole lenses is 18.0 mm in the center of the display screen with perpendicular incidence and is 12.7 mm at the edge of the curved display screen where the electron beams are incident at an angle of approximately 37° to the normal of the display screen. The distance of the colour selection means 7 to the display screen 6 is 15 mm in the center and is 10 mm at the edge, so that the focus of the quadrupole lenses is everywhere just slightly beyond the display screen so as to prevent a so-called focus ring from becoming visible on the display screen. The electron spots are then again approximately 0.10 mm wide so that a suitable width of the phosphor strips R, G and B is again 0.13 mm.

What is claimed is:

1. An article of manufacture comprising first and second apertured metal sheets defining first and second electrodes, respectively, of a color selection electrode system for a color display tube and insulating means for maintaining said sheets in substantially congruent relationship with each other with the apertures in said first sheet being aligned in a predetermined relationship with the apertures in the second sheet; said insulating means being disposed between solid areas of said sheets and comprising a solid insulating core surrounded by an outer jacket, said jacket having a softening temperature lower than the softening temperature of said core so that upon heating the assembly formed by said sheets and said insulating means to a temperature at which said jacket is softened sufficiently to flow into contact with and adherently join said sheets to said core, said core remains solid forming an insulating spacer which maintains said sheets spaced a predetermined distance from each other.

2. The article of manufacture of claim 1 in which said jacket is solidified in situ to adherently join said metal sheets to said core.

3. The article of manufacture of claim 1 in which said insulating means comprises a glass fiber wound around said first sheet with sections of said fiber in between said first and second sheets and said fiber comprises a core of glass having a relatively high softening temperature forming said core and a sheath of glass having a relatively low softening temperature forming said jacket.

4. The article of manufacture of claim 1 in which the apertures in said first sheet have approximately equal height and width and said second sheet comprises a plurality of metal strips extending parallel to the height direction of the apertures in said first sheet, said strips being spaced from each other a distance substantially equal to the width of the apertures in said first sheet to define the apertures in said second sheet.

5. The article of manufacture of claim 4 in which said insulating means comprises a plurality of insulating cylinders disposed between said sheets, the axial direction of said cylinders being substantially parallel to the height direction of said apertures in said first sheet, each of said cylinders being disposed between one of said metal strips of said second sheet and a substantially parallel solid area of said first sheet.

6. The article of manufacture of claim 1 in which said insulating means comprises a plurality of insulating members, each comprising said solid insulating core and said jacket, said insulating members being disposed at laterally spaced positions between said sheets.

7. The article of manufacture of claim 6 in which the core of each of said insulating members comprises glass having a relatively high softening temperature and the jacket of each of said insulating means comprises a second type of glass having a relatively low softening temperature.

8. The article of manufacture of claim 7 in which said insulating members are cylinders.

9. The article of manufacture of claim 7 in which said insulating members are spheres.

10. The article of manufacture of claim 6 in which said core of each of said insulating members comprises a ceramic material and said jacket of each of said insulating members comprises glass.

11. The article of manufacture of claim 1 in which said first sheet comprises a plurality of first parallel strips and said apertures in said first sheet are elongated slots defined by said strips, said second sheet comprises a plurality of second parallel strips extending substantially perpendicularly to said first strips and said apertures in said second sheet are elongated slots defined by said second parallel strips, and said insulating means includes a plurality of insulating members disposed between cross-over points of said first and second parallel strips, each of said insulating members comprising said core and said jacket.

12. The article of manufacture of claim 11 in which said insulating members are substantially spherical.

13. A color display tube comprising an evacuated envelope, means to generate a plurality of electron beams, a display screen comprising a plurality of elongated regions luminescing in different colors, means for selectively impinging said beams each upon a respective color luminescent regions, said means for impinging comprising a first and a second system of lens electrodes defining apertures and having a potential difference between said first and second system to define a quadrupole lens in each of the apertures, the electric field of each said lens being substantially at a right angle to the path of electrons passing through the respective aperture, means for separating a lens electrode of the first system a predetermined distance from a lens electrode of the second system, said separating means comprising at least one member of an electrically insulating material positioned between the facing surfaces of the electrodes of said first and second systems, said member comprising a core for separating said electrodes by said predetermined distance and a jacket which adheres to the electrodes, said core consisting of a material having a higher melting-point than the material of the jacket.

* * * * *